US005361051A

United States Patent [19]

DiMarco et al.

[11] Patent Number: 5,361,051

[45] Date of Patent: Nov. 1, 1994

[54] PIVOTING CIRCUIT BREAKER CONTACT ARM ASSEMBLY

[75] Inventors: Bernard DiMarco, Lilburn; Steven A. Kaufman, Decatur, both of Ga.

[73] Assignee: Siemens Energy & Automation, Inc., Alpharetta, Ga.

[21] Appl. No.: 285,479

[22] Filed: Dec. 16, 1988

[51] Int. Cl.[5] ..... H01H 75/00

[52] U.S. Cl. ..... 335/16; 200/244; 335/147

[58] Field of Search ..... 335/6, 16, 147, 195; 200/147 R, 244

[56] References Cited

U.S. PATENT DOCUMENTS

| | | | |
|---|---|---|---|
| 3,345,485 | 10/1967 | Engel | 335/16 |
| 3,562,680 | 2/1971 | Ozaki et al. | 335/16 |
| 3,663,903 | 5/1972 | Kussy et al. | 335/16 |
| 3,958,197 | 5/1976 | Gryctko | 335/18 |
| 4,245,203 | 1/1981 | Wafer et al. | 335/16 |
| 4,259,651 | 3/1981 | Yamat | 335/16 |
| 4,319,104 | 3/1982 | Decroix et al. . | |
| 4,458,224 | 7/1984 | Kralik et al. | 335/16 |
| 4,484,164 | 11/1984 | McClellan et al. | 200/244 |
| 4,488,133 | 12/1984 | McClellan et al. | 335/16 |
| 4,528,531 | 7/1985 | Flick et al. | 335/23 |
| 4,594,567 | 6/1986 | DiMarco et al. | 335/16 |

*Primary Examiner*—Leo P. Picard
*Assistant Examiner*—Lincoln Donovan
*Attorney, Agent, or Firm*—James G. Morrow; Peter A. Luccarelli, Jr.

[57] ABSTRACT

Assemblies for providing the contacts of a circuit breaker with a pivoting motion. Each assembly is adapted to electrically couple the contact to the base of the assembly which is connectable to a terminal of the circuit breaker. Each assembly includes an arm for supporting an electrical contact, a pivot pin for pivotally mounting the arm, a base for supporting the pivot pin, and means for urging the pivot pin into contact with contact surfaces of the base. The arm is pivotable about the longitudinal axis of the pivot pin, and the arm and pivot pin are arranged such that at least two contact locations occur between the arm and the pivot pin.

13 Claims, 4 Drawing Sheets

PIVOTING CIRCUIT BREAKER CONTACT ARM ASSEMBLY

BACKGROUND OF THE INVENTION

This invention relates to a circuit breaker, and more particularly to the pivoting contact carrying arms of a circuit breaker.

In general, a circuit breaker opens an electrical circuit by separating the current carrying contacts of the circuit breakers. One way of moving contacts, for the purpose of separation, is to mount the contacts on pivoting arms and provide means for pivoting the arms. This type of arrangement is illustrated in U.S. Pat. No. 4,245,203. While the task of separating contacts using pivoting arms may appear to be relatively straightforward, this is normally not the case since a current path between the contact and the pivoting arm base is required. For example, the current path between the contact and the base for the pivot arm can be completed with a flexible wire. The current path between the contact and the support can also be completed with the pivot joint between the pivot arm and the support.

While flexible wires and pivot joints can be used to complete the current path between the contact and the pivoting arm base, these arrangements have problems. For example, some of the problems with the use of flexible wires, are that flexible wires are subjected to much movement over the life of the circuit breaker and are susceptible to fatigue and other types of failure, and some of the problems with the use of a pivot joint, are that the pivot joint can be subjected to electromagnetic blow apart forces and heating due to contact resistance within the joint.

Turning now to the problem of blow apart forces, FIG. 7 is a schematic representation of the current flow through a contact location. The current is represented by the arrows labeled I. This current (I) can be broken into components, and the arrows marked A represent components of the current (I) flowing toward the contact location, and the arrows marked B represent components of the current (I) flowing away from the contact location. These current components A and B, and their associated magnetic fields, interact to produced forces (blow apart forces) which tend to separate the contacts 1, 2. In a pivot joint, the blow apart forces tend to deflect the pivot joint apart to decrease contact pressures. This deflection can result in increased resistance and heating within the joint. Additionally, the deflection within the joint can cause arcing which in turn causes erosion of the pivot joint.

Accordingly, it would be desirable to provide a contact carrying arm pivot joint adapted to carry a portion of or the whole load current of a circuit breaker, wherein the joint minimizes the adverse effects of blow apart forces at the contact locations within the joint.

BRIEF DESCRIPTION OF THE PREFERRED EMBODIMENT

An object of the present invention is to provide a pivoting contact arm assembly which is adapted to react to blow apart forces such that the adverse effects on the pivoting contact arm assembly are minimized.

Accordingly, there is provided a pivoting circuit breaker contact arm assembly including an electrical contact mounted to an arm for supporting the electrical contact, a pivot pin for pivotally mounting the arm, a base for supporting the pivot pin, and means for urging the pivot pin into contact with contact surfaces of the base. The arm is pivotable about the longitudinal axis of the pivot pin, and the arm and pivot pin are arranged such that at least two contact locations occur between the arm and the pivot pin.

An advantage of the present invention is that it provides a relatively inexpensive configuration for reacting to the blow apart forces occurring within a pivoting contact arm assembly. Another advantage of the present invention is that it provides a plurality of contact locations within the pivoting contact arm assembly which assist in increasing the current carrying capacity of the pivoting contact arm assembly.

Various other objects and advantages of the present invention will become apparent from the following description, with reference to the accompanying drawings.

DETAILED DESCRIPTION OF THE PREFERRED EMBODIMENT

Figure 1:
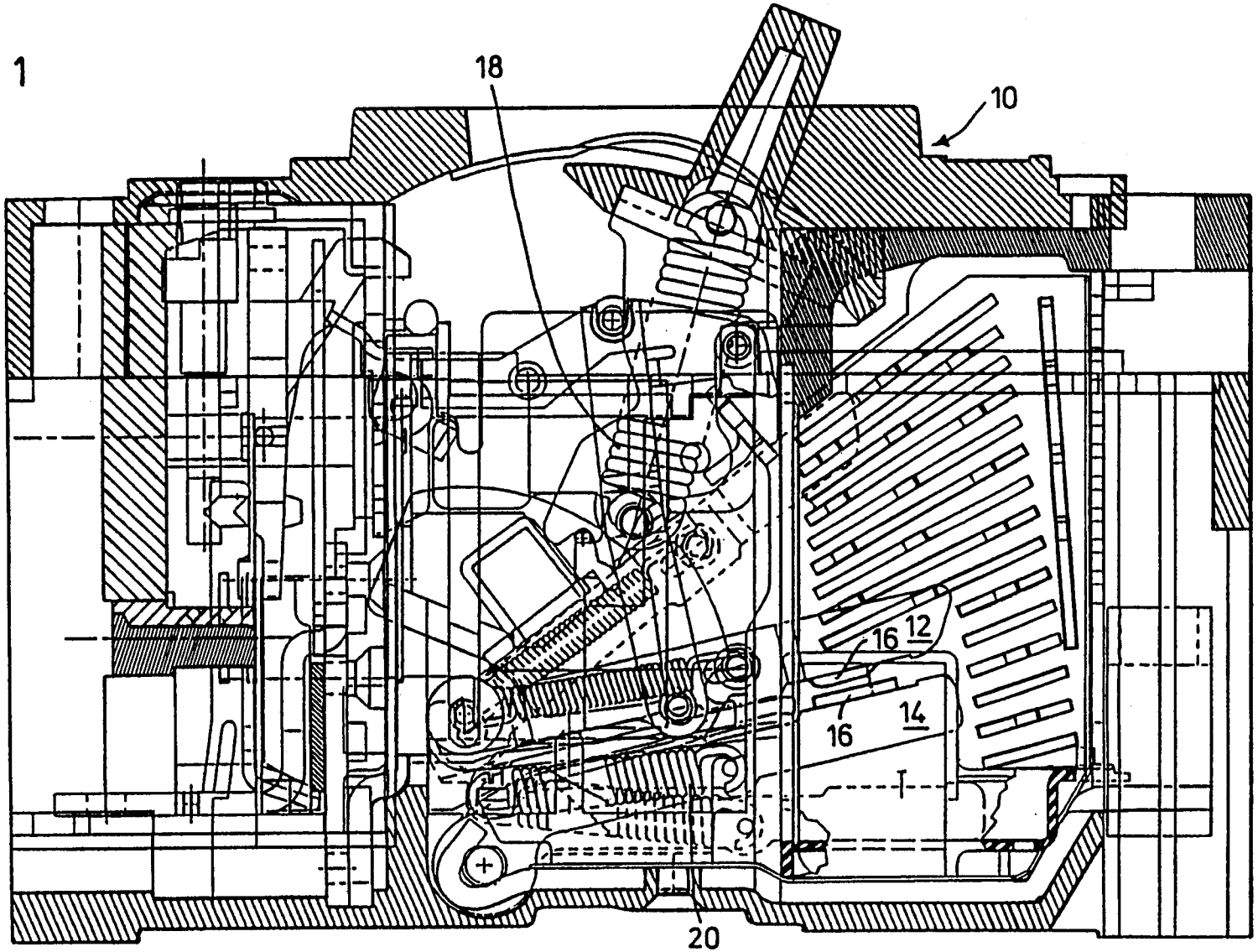
FIGS. 1 and 1*a* are side views of a circuit breaker including the pivoting contact arm assembly.
Figure 1A:
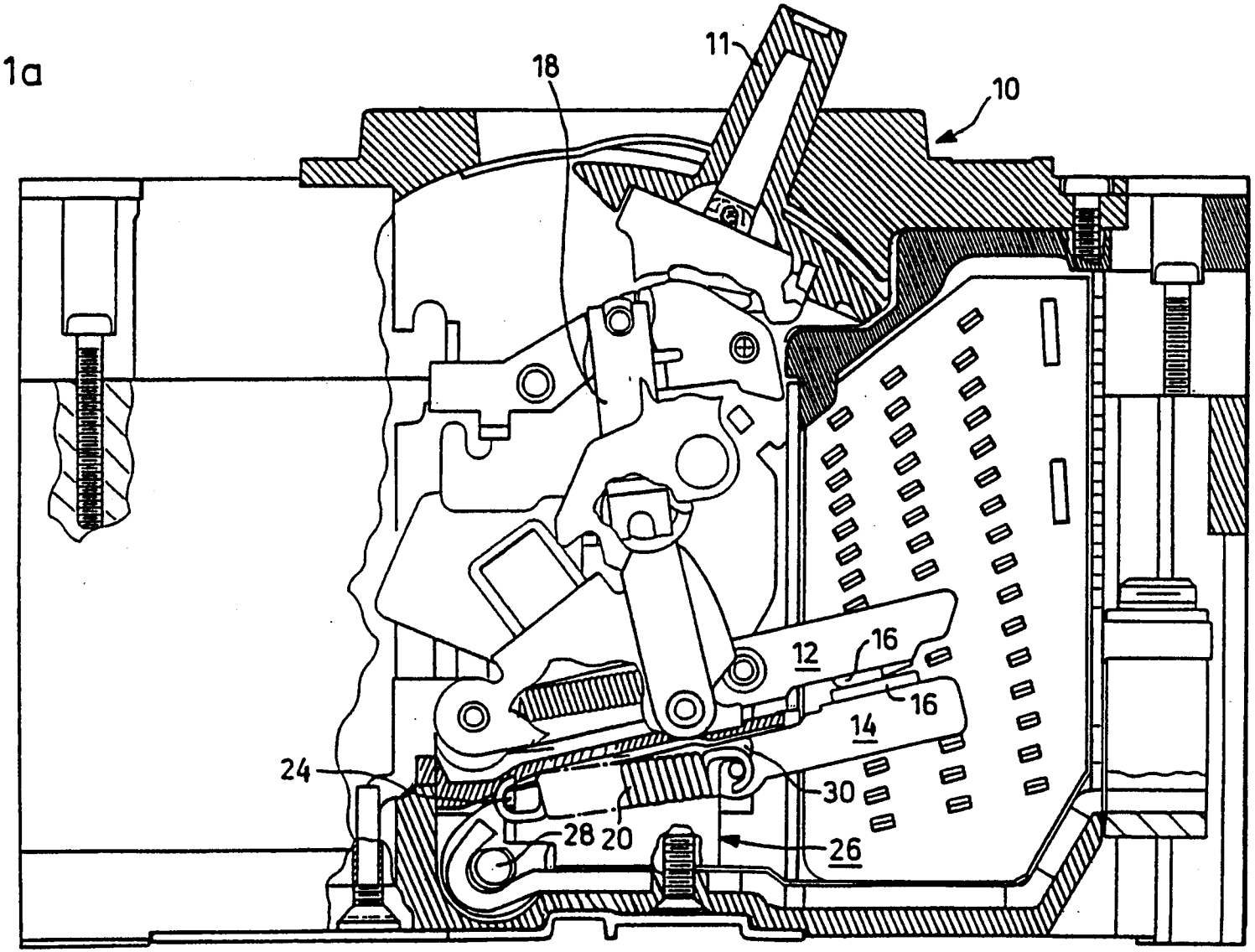

Referring now to the drawings, FIGS. 1 and 1*a* illustrate one pole of a circuit breaker 10 including two pivoting contact arms 12, 14 which each include an electrical contact 16. The top contact arm 12 is pivoted upwardly by an operating mechanism 18 and the bottom contact arm 14 can be pivoted downwardly by blow apart forces which can occur between the contacts 16.

Figure 2:
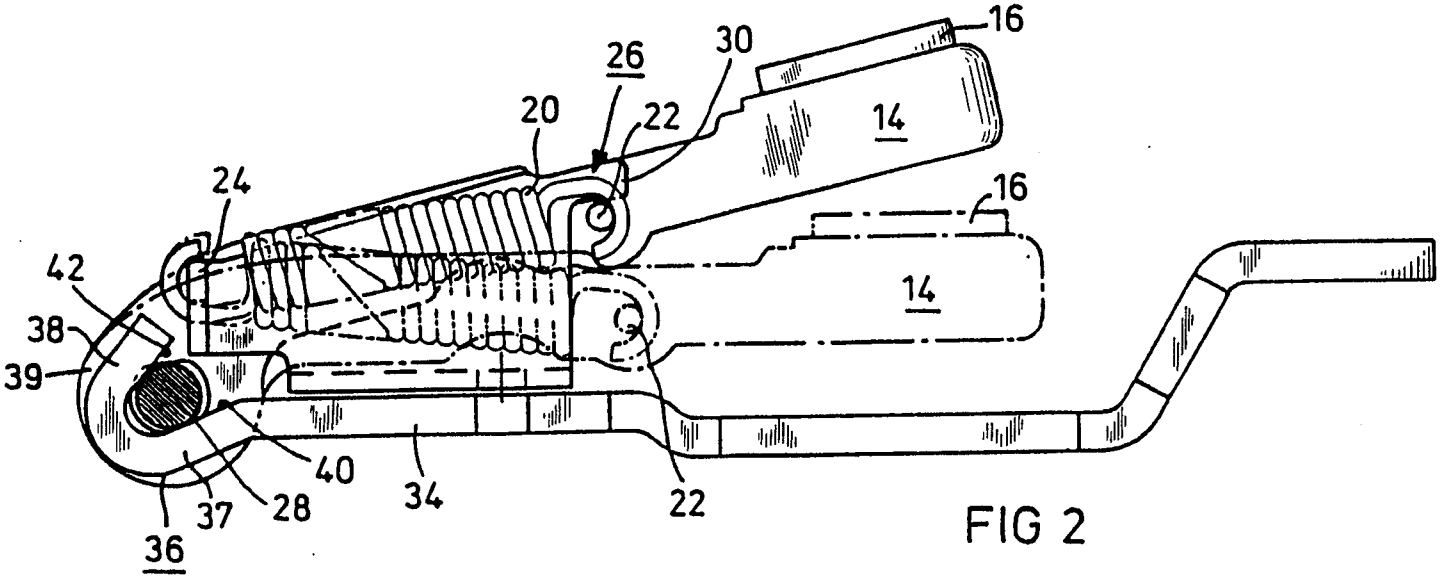
FIG. 2 is a side view illustrating two positions of the pivoting contact arm assembly.
Figure 3:
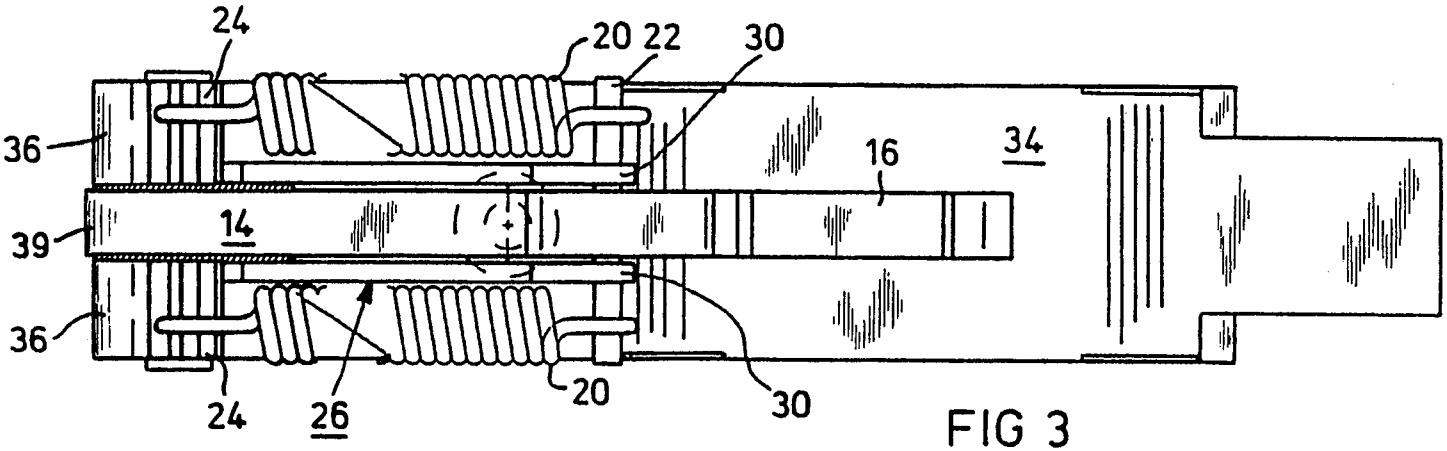
FIG. 3 is a top view of the pivoting contact arm assembly.

FIG. 2 illustrates two positions of the pivoting contact arm 14 which is pivotable upon a pivot pin 28. The position of the arm 14 illustrated by the dashed lines is a position the arm 14 can pivot into when the contacts 16 blow apart. The position of the arm 14 illustrated by the solid lines is the stable position of the arm 14. This position of the arm 14 is maintained by the springs 20. Each spring 20 extends between a pin 22 and a flange 24. The pin 22 extends through the arm 14, and the flanges 24 are part of a stop member 26. Referring now to FIGS. 2 and 3, stop 26 also includes two stops 30 which interfere with the pin 22 such that the arm 14 has limited rotational movement in the counter-clockwise direction. The stop member 26 can be fixed to a base or line terminal 34 with a rivet 32 as shown in FIG. 4.

Figure 4:
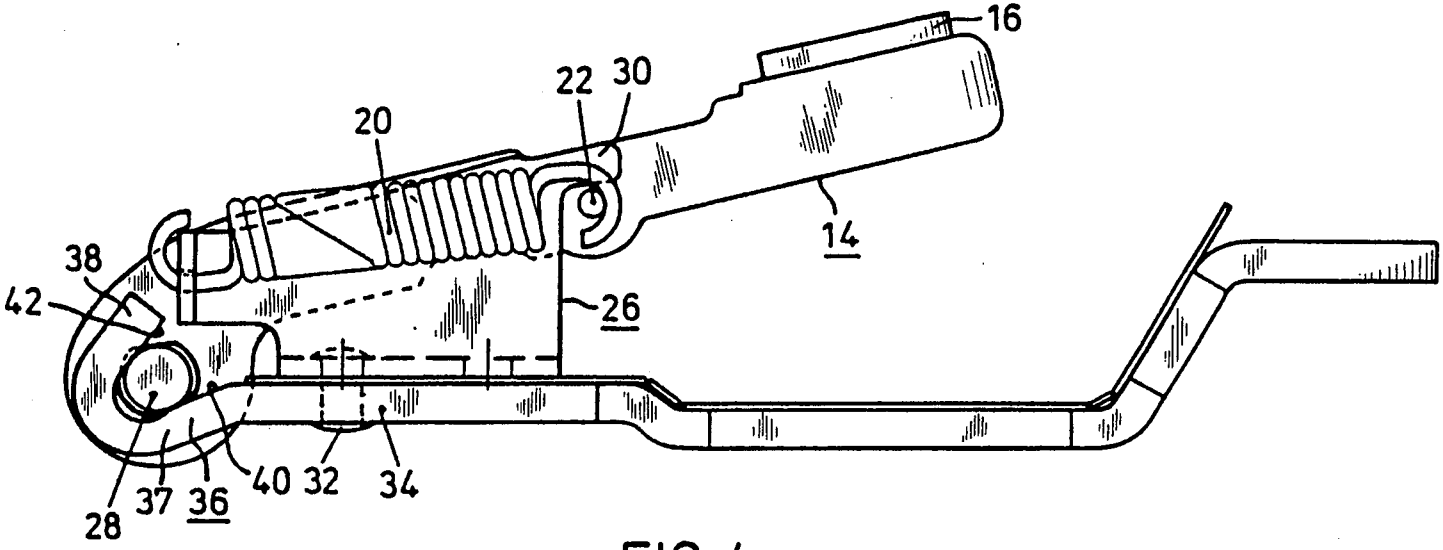
FIG. 4 is a side view of the pivoting contact arm assembly.
Figure 5:
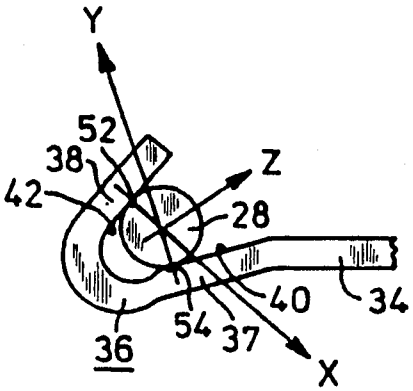
FIG. 5 is an enlarged view of a portion of the pivoting contact arm assembly.
Figure 7:
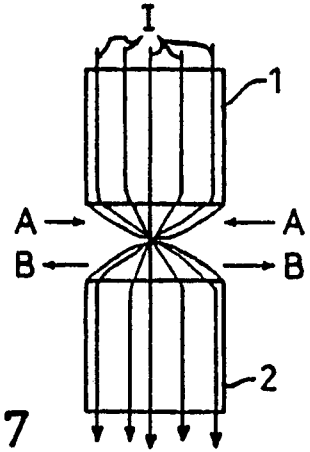
FIG. 7 is a schematic illustration of a pair of contacts and their location of contact.

Referring now to FIGS. 3, 4 and 5, these figures illustrate the end configuration of the line terminal 34 which contacts and supports the pivot pin 28. The end configuration is bifurcated into two curved hooking members 36 such that the end portion 38 of the arm 14 can rest between the members 36. Since the springs 20 are in tension, the springs 20 cause the arm 14 to force the pivot pin 28 against the inside surfaces 40, 42 of the hooking members 36. This configuration provides two (2) electrical contact locations between the pivot pin 28 and each hooking member 36. Accordingly, this configuration provides four (4) electrical contact locations between the pivot pin 28 and the line terminal 34.

Figure 6:
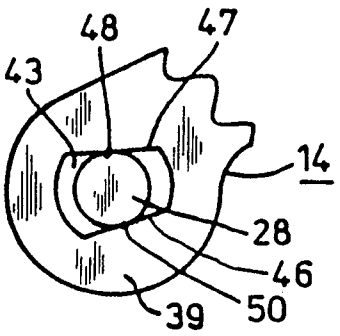
FIG. 6 is an enlarged view of another portion of the pivoting contact arm assembly.

As shown in FIG. 6, springs 20 also force the inside surfaces 44, 46 against the pivot pin 28 to provide two (2) electrical contact locations 48, 50 between the pivot pin 28 and the arm 14. To provide increased contact pressure between the inside surfaces 44, 46 and the pivot pin 28, the surfaces 44, 46 are arranged such that the pivot pin 28 is wedged between the surfaces when the springs 20 act upon the arm 14. (See FIG. 6.) Accordingly, current can flow from the contact 16 to the line terminal 34 via: the arm 14; the contact locations 48, 50 between the arm 14 and the pivot pin 28; and the contact locations 52, 54 between the pivot pin 28 and the line terminal 34.

Referring again to the problem of blow apart forces, this problem will now be discussed in reference to the preferred embodiment. As discussed above, blow apart forces can occur at contact locations when currents flow through the contact locations, and these forces tend to separate the members in contact at the contact locations. The contact locations 52, 54 between the pivot pin 28 and the surfaces 40, 42 of the hooking member 36 are illustrated in FIG. 5. During the operation of a the circuit breaker 10 the current flowing through the contact locations 52, 54 causes a repulsion force between the pivot pin 28 and the surfaces 40, 42. The repulsion force at the contact location 52 falls generally along line X and the repulsion force at the contact location 54 falls generally along line Y.

The hooking member 36 is configured such that the repulsion forces at the contact locations 52, 54 substantially cancel each other. This is accomplished by orienting the surfaces 40, 42 so that they are almost parallel. In the preferred embodiment, the surfaces 40, 42 are not absolutely parallel. This allows the springs 20 to wedge the pivot pin 28 in contact with the surfaces 40, 42. Since the surfaces 40, 42 are not absolutely parallel, the forces do not completely cancel and there is a resultant force which falls generally along line Z.

While a resultant force along line Z may urge the pivot pin 28 from within the hooking member 36, the springs 20 are tensioned so that the force along line Z does not reduce the contact pressure at the contact locations 52, 54 below an acceptable minimum.

While one embodiment of an arcing assembly has been shown and described in detail herein, various other changes and modifications may be made without departing from the scope of the present invention.

We claim:

1. A pivoting circuit breaker contact arm assembly comprising:

an electrical contact;

an arm for supporting the electrical contact, wherein the electrical contact is mounted to the arm;

a pivot pin for pivotally mounting the arm, the arm being pivotable about the longitudinal axis of the pivot pin, wherein at least two contact locations occur between the arm and the pivot pin;

a base for supporting the pivot pin, wherein the base includes at least four contact surfaces, the surfaces being disposed such that the repulsion forces generated between the pivot pin and the contact surfaces substantially offset one another; and means for urging the pivot pin into contact with the contact surfaces.

2. The assembly of claim 1 wherein the base is bifurcated into a first section and a second section, the sections having a curved shape and including two of the contact surfaces.

3. The assembly of claim 2 wherein the pivot pin passes through an opening in the contact arm, the opening being generally circular and including two substantially flat surfaces, wherein the contact locations occur between the pivot pin and the contact arm at the flat surfaces.

4. The assembly of claim 3 wherein the means for urging comprises:

a pin passing through the arm;

a support fastened to the base, the support including at least two flanges;

means for fastening the support to the base; and at least two springs including a first end and a second end, the first end of each spring being attached to the pin and the second end of each spring being attached to one of the flanges.

5. The assembly of claim 4 wherein the support includes two pin stops and the springs urge the pin into contact with the stops.

6. A pivoting circuit breaker contact arm assembly comprising:

an electrical contact;

an arm for supporting the electrical contact, wherein the electrical contact is mounted to the arm;

a pivot pin for pivotally mounting the arm, the arm being pivotable about the longitudinal axis of the pivot pin, wherein the pin passes through an opening in the contact arm, the opening including a first substantially flat surface and wherein at least two contact locations occur between the arm and the pivot pin;

a base for supporting the pivot pin, wherein the base is bifurcated into a first section and a second section, and each section has a curved shape including two contact surfaces; and means for urging the pivot pin into contact with the contact surfaces.

7. The assembly of claim 6 wherein the opening is generally circular and further includes a second substantially flat surface, wherein the contact locations occur between the pivot pin and the contact arm at the first and second flat surfaces.

8. The assembly of claim 7 wherein the means for urging comprises:

a pin passing through the arm;

a support fastened to the base, the support including at least two flanges;

means for fastening the support to the base; and at least two springs including a first end and a second end, the first end of each spring being attached to the pin and the second end of each spring being attached to one of the flanges.

9. The assembly of claim 8 wherein the support includes two pin stops and the springs urge the pin into contact with the stops.

10. A circuit breaker including a pivoting circuit breaker contact arm assembly, the assembly comprising:

an electrical contact;

an arm for supporting the electrical contact, wherein the electrical contact is mounted to the arm;

a pivot pin for pivotally mounting the arm, wherein the pivot pin passes through an opening in the contact arm, the opening being generally circular and including two substantially flat surfaces, the arm being pivotable about the longitudinal axis of the pivot pin, wherein at least two contact locations occur between the arm and the pivot pin;

a base for supporting the pivot pin, wherein the base is bifurcated into a first section and a second section, and each section has a curved shape including two contact surfaces; and means for urging the pivot pin into contact with the contact surfaces.

11. The assembly of claim 10 wherein the means for urging comprises:

a pin passing through the arm;

a support fastened to the base, the support including at least two flanges;

means for fastening the support to the base; and at least two springs including a first end and a second end, the first end of each spring being attached to the pin and the second end of each spring being attached to one of the flanges.

12. The assembly of claim 11 wherein the support includes two pin stops and the springs urge the pin into contact with the stops.

13. A circuit breaker including a stationary contact, a movable contact operable into and out of engagement with said movable contact, an elongaged contact arm having said stationary contact at one end thereof, a pivot to which the other end of said contact arm is mounted for pivotal movements of said contact arm between circuit breaker on and off positions, a conducting support for said pivot, the points of contact between said pivot and said support tending to be subjected to blow apart forces, the circuit breaker improved wherein:

said support includes a plurality of said points of contact disposed relative to one another to offset a substantial portion of said blow apart forces at said points of contact.

* * * * *